US006063192A

United States Patent [19]

Gottwald et al.

[11] Patent Number: 6,063,192

[45] **Date of Patent: *May 16, 2000**

[54] METHOD AND APPARATUS FOR WET-IN-WET COATING OF A MOVING LAYER OF MATERIAL

[75] Inventors: Ingo Gottwald, Steinheim; Bernhard Kohl, Heidenheim; Albrecht Meinecke, Heidenheim; Benjamin Mendez, Heidenheim; Michael Trefz, Heidenheim; Martin Kustermann, Heidenheim, all of Germany

[73] Assignee: Voith Sulzer Papiermaschinen GmbH, Heidenheim, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/873,443

[22] Filed: Jun. 12, 1997

[30] Foreign Application Priority Data

Jun. 13, 1996 [DE] Germany ..... 196 23 622

[51] Int. Cl.[7] ..... B05C 1/08; B05C 1/12

[52] U.S. Cl. ..... 118/224; 118/249; 118/258; 118/259; 118/261; 118/262; 427/428

[58] Field of Search ..... 427/428; 118/223, 118/224, 249, 258, 259, 261, 262

[56] References Cited

U.S. PATENT DOCUMENTS

| | | | |
|---|---|---|---|
| 2,645,201 | 7/1953 | Muggleton | 118/227 |
| 2,802,752 | 8/1957 | Wood, Jr. | 427/428 |
| 3,539,426 | 11/1970 | Nakai et al. | 156/249 |
| 4,474,836 | 10/1984 | Lukoschek et al. | 427/428 |
| 5,171,612 | 12/1992 | Sollinger | 427/428 |
| 5,340,611 | 8/1994 | Kustermann et al. | 427/428 |
| 5,789,022 | 8/1998 | Kustermann et al. | 427/428 |

FOREIGN PATENT DOCUMENTS

| | | | |
|---|---|---|---|
| 27 05 273 A1 | 8/1978 | Germany | B05D 1/28 |
| 40 13 776 A1 | 10/1991 | Germany | B05C 9/06 |
| 39 22 535 C2 | 7/1994 | Germany | B05D 1/36 |
| 42 24 717 C2 | 12/1994 | Germany | D21H 23/70 |
| 44 14 921 A1 | 11/1995 | Germany | B05C 11/02 |
| 4001/76 | 8/1977 | Switzerland | B05D 1/36 |
| WO 92/00419 | 1/1992 | WIPO | D21H 23/70 |

*Primary Examiner*—Katherine A. Bareford
*Attorney, Agent, or Firm*—Taylor & Aust, P.C.

[57] ABSTRACT

A method and apparatus for coating a traveling layer of material, in particular paper and/or cardboard. An applicator implement applies a predetermined and proper amount of a liquid or pasty medium onto an outer surface of a first rotating applicator roller which in turn transfers the liquid or pasty medium onto a first side of the moving layer of material just as it is moving through a press nip. A second layer of coating medium is applied indirectly with a second applicator implement onto an outer surface of a second rotating applicator roller from where it is transferred onto the previously coated side of the moving material layer while the first coat of coating medium is still wet.

8 Claims, 2 Drawing Sheets

METHOD AND APPARATUS FOR WET-IN-WET COATING OF A MOVING LAYER OF MATERIAL

BACKGROUND OF THE INVENTION

1. Field of the Invention

The present invention relates to a method and apparatus for the coating of a running layer of material, in particular paper and/or cardboard.

2. Description of the Related Art

Patent Document EP 0 438 743 B1 describes a process which basically consists of applying two wet coatings on a moving layer of material whereby the second coating is applied while the first coating is still wet. The first coating is spread upon the outer surface of an applicator roller and then the coating material is pressed upon the layer of material as it is moving through a press nip that is formed between this applicator roller and a counter roller which presses the material layer against the applicator roller. The second layer of coating is applied via a jet chamber onto a spreader roller or a spreader blade in direct application on top of the first layer of coating. As an alternative to this combination of spreader roller and jet chamber another device is recommended which employs a scoop roller where a transfer roller scoops the wet coating substance out of a holding basin and directly applies it upon the moving material layer.

DE 39 22 535 C2 also describes a process to apply two layers of coating material, one on top of the other, on a moving layer of material while the bottom layer is still wet, and the equipment to facilitate the process. The first layer of coating is applied indirectly whereby the coating substance is applied onto the outer surface of an applicator roller by a combination of spreading element and jet chamber before it is transferred onto the layer of material as it is moving through a press nip formed in-between the applicator roller and a counter roller. The second layer of coating is subsequently applied directly onto the first layer of coating again with a combination of spreading element and jet chamber, where a spreader blade smoothes the surface of the second layer of coating.

For a number of different products these two processes and the associated machineries provide good results where a pre-coating and a final coating, that is two coatings on top of one another, are required, but other applications demand smoother coatings, especially a smooth top coating is often essential.

SUMMARY OF THE INVENTION

The present invention provides a process and the associated equipment necessary to produce two layers of coatings where the quality of the second layer on top is enhanced.

According to the process prescribed by the present invention, the first step consists of applying a layer of the first of the two sorts of liquid or pasty substances by an applicator implement which determines the precise quantity of this substance before it is spread onto the outer cylindrical surface of a rotating applicator roller. From there the layer of liquid or pasty substance is transferred by the rotation of the applicator roller within a compression gap that is formed between the applicator roller and a counter roller where it is dispensed onto one side of the layer of moving material. The first layer of liquid or pasty substance is therefore applied in an indirect manner onto the moving layer of material since the pasty substance is first applied onto an applicator roller before it is finally from there spread onto the moving layer of material. The first step of this operation also entails an act of compression during which the liquid or pasty substance is squeezed into the material of the moving layer. While this first applied layer is still moist a second layer of another or the same liquid or pasty substance is applied on top of it as a second operation. According to the invention this second layer is also applied in an indirect fashion onto the layer of moving material. Just as the previous operation the second layer of liquid or pasty substance is first applied onto an applicator roller before it is from there spread onto the moving layer of material According to the invention presented here both layers of the pasty or liquid substance are applied in an indirect way onto the surface of the layer of material, that is to say that an applicator implement is spreading the media onto the outer cylindrical surface of an applicator roller before these media are from there transferred onto the moving layer of material. The first step of the operation, the application of the first layer of liquid or pasty medium, takes place within a compression gap as the medium is being squeezed into the moving layer of material, whereby the medium, for example paint, is loosing the majority of its water content because the majority of the liquid phase enters the layer of material, for example paper, while the solid components remain on the surface of the material layer where the are beginning to form a sort of filter cake. The liquid components will for the most part have entered the material layer and only a very thin film of liquid paint will remain on top of the filter cake. The thickness of this liquid film is small in comparison to the filter cake. This first dehydrated layer of coating, that is filter cake, provides a very good foundation on which the second layer of coating can be applied without an intermediate drying step. Applying the second layer of coating in this prescribed manner brings out a number of different advantages for the various embodiments of the invention.

In the first of the preferred embodiments of the process described by this invention, the second stage of the coating operation begins by applying a predetermined amount of liquid or pasty substance onto the cylindrical surface of a second rotating applicator roller which is subsequently transferred by the applicator roller onto the moving layer of material under the influence of an applied pressure which squeezes the second medium into the material layer as well. This embodiment has the advantage that the second layer of coating also loses a large portion of its liquid phase.

In the second of the preferred embodiments of the process described by this invention, the second stage of the coating operation transfers the liquid or pasty medium from the outer surface of the second applicator roller onto the moving layer of material such that the surface of the applicator roller is moving counter to the relative motion of the material layer. The layer of material is thus receiving the liquid or pasty coating medium as it is running against the relative movement of the applicator roller. This sort of procedure is particularly suited for the application of coating media with a very low viscosity, for example to apply a thermo-sensitive finish coating. Thermal coatings are utilized to produce paper for FAX machines with thermal print devices, which is in essence a paper that darkens under the influence of light. This thermo-sensitive effect is caused by the second layer of coating. This sort of procedure is furthermore utilized to apply a spreading medium that contains micro capsules. Paper that has been coated with a layer of finely distributed micro capsules is being used as the sort copy paper that will produce a copy of the page that is printed on by releasing a color as the micro capsules burst under the pressure of the printing device to, for example, a sheet of paper below it.

The coating process according to this invention, which consists of applying the second layer of coating, that is the finish coating, in an indirect fashion provides on one hand a way to separate the water from the second layer as it is applied, because the second layer is also applied under pressure so that the liquid is squeezed into the layer, on the other hand it can be applied so that the second layer of coating is applied while the applicator roller is moving against the relative direction of the layer of material which allows the coating medium to be applied very gently which is of great concern for the coating of paper with micro capsules which may burst under the pressure of the printing device. The coating procedure according to this invention provides certain advantages for some special purposes where other methods would not produce the same high quality of coating.

An apparatus that can perform the coating procedure according to this invention incorporates a rotating counter roller which supports at least a portion of the moving material layer with its outer cylindrical surface. This apparatus furthermore contains an applicator roller which rotates opposite to the counter roller and which is spaced relative to the location of the counter roller leaving an opening which is the press nip. In the process the moving material layer is guided through this press nip. An applicator implement is aimed at the outer cylindrical surface of the first applicator roller which in the process will dispense the liquid or pasty medium at a predetermined rate. After the moving material layer has passed the first press nip it moves to a second applicator roller while still being supported by the same counter roller whose location is also controlled relative to the second applicator roller. A second applicator implement is aimed at this second applicator roller in order to apply a second coating onto the outer surface of this second applicator roller before the liquid or pasty medium is transferred onto the moving material layer. In other words, there is a common counter roller, whose outer cylindrical surface supports at least a portion of the moving material layer, which at the first location where the moving layer of material is supported (contacted) by this counter roller is met by a first applicator roller which in turn is coated by a first applicator implement with the liquid or pasty coating medium, and which further along the line of the passage of the material layer, at a second location where the moving layer of material is supported (contacted) by this counter roller is met by a second applicator roller which in turn is coated by a second applicator implement with coating medium. The utilization of the common counter roller, which acts in conjunction with two applicator rollers, each with their own associated coating applicator implements, results in a very compact construction.

The first preferred embodiment features the second applicator roller rotating opposite to the direction of the counter roller and it is spaced relative to the counter roller so that a press nip is formed through which the moving layer of material is passing. The devices for applying the second layer of coating, that means the second applicator roller and the second applicator implement, are analogous to the devices for applying the first layer of coating, and each coating process involves the squeezing action with which the coatings are pressed into the moving layers of material.

A special embodiment features the two applicator rollers positioned symmetrically about a plane to which the center axis or the axis of rotation of the common counter roller is a subset so that this plane of symmetry constitutes also a centroidal plane of the counter rollers. Consequently, the axis of rotation of the counter roller and the axes of rotation of both applicator rollers are located on the same plane. This furthermore necessitates that the two points of tangency at which the counter roller and each of the applicator rollers touch one another and which form very thin slit, the press nips, are also located on the same plane which is common to the center axes of each of the rollers. In addition to these peculiar geometrical features, it can also be pointed out that the path of the moving layer of material from where it enters the first press nip between the first applicator roller and the counter roller up to the point where it passes the second press nip between the second applicator roller and the counter roller, forms a trajectory which in itself is also symmetrical with respect to the above mentioned plane of symmetry. This sort of geometrical assemblage results in a very compact and space saving arrangement for the entire machinery. The often referred to plane of symmetry should be preferably kept either vertical or horizontal, but if necessary it can also be inclined in any desirable angle.

A further preferred embodiment of the apparatus which is described in this invention is the introduction of a deflection pulley, rotary stretcher or expander roller which will guide the moving layer of material after it has passed the first press nip and before it enters the second press nip. The introduction of such deflection pulley, rotary stretcher or expander roller allows that the moving layer of material is lifted up from the surface of the counter roller. The purpose behind this maneuver is to prevent the formation of folds or wrinkles within the moving layer of material. In case of the before mentioned planar symmetrical arrangement it would be preferable to position the deflection pulley, rotary stretcher or expander roller in the plane of symmetry.

A second preferred embodiment of the apparatus described by this invention incorporates a second applicator roller which rotates in the same direction as the counter roller. This embodiment does not include a press nip in-between the counter roller and the second applicator roller where pressure is applied onto the moving material layer as it is passing through but the material layer is passing through an open gap at all time and fully supported by the counter roller while the outer cylindrical surface of the applicator roller moves opposite to the relative movement of the material layer. In other word a point on the outer cylindrical surface of the second applicator roller as it moves past this open gap moves opposite to the direction of the nearest point on the outer cylindrical surface of the counter roller. This arrangement of roller rotations causes the second liquid or pasty substance to move against the relative motion of the layer of material at the time of impact as this material layer is guided and supported by the counter roller. The liquid or pasty medium will build up on the side of the open gap where the outer surface of the second applicator roller approaches the open gap. This applicator roller is known as a "Reverse Roll Coater."

A preferred arrangement for the second embodiment, where the second applicator roller rotates in the way as the counter roller, for example looking on ends both would rotate clockwise, features a scooping arrangement in place of the applicator implement where a scoop roller scoops the second liquid or pasty medium out of a container and then transfers it onto the second applicator roller.

A preferred arrangement for the first and second embodiments of the apparatus described by this invention, which on one hand is the embodiment featuring a second press nip and which in the other hand is the embodiment featuring the second applicator roller rotating in the way as the counter roller, that is looking on ends both would rotate clockwise, utilizes a jet nozzle as an implement to apply precisely determined amounts of the liquid or pasty substance onto the second applicator roller. This jet nozzle implement is preferably built as either a free streaming jet applicator implement or as an applicator implement that consists of a combination of spreading element and pressure chamber. The free streaming jet applicator implement is basically a thin crack through which a free stream of liquid or pasty medium is propelled onto the surface of the second applicator roller. The other device consisting of a combination of spreading device and pressure chamber is basically a closed applicator chamber which is formed by a the spreader element, a deckle board and the surface of the second applicator roller. The spreader element in this case can be either singular or plural, either straight or contoured rolling wiper stick(s), coater blade(s), or deckle board(s) which distribute liquid or pasty medium out of the chamber.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
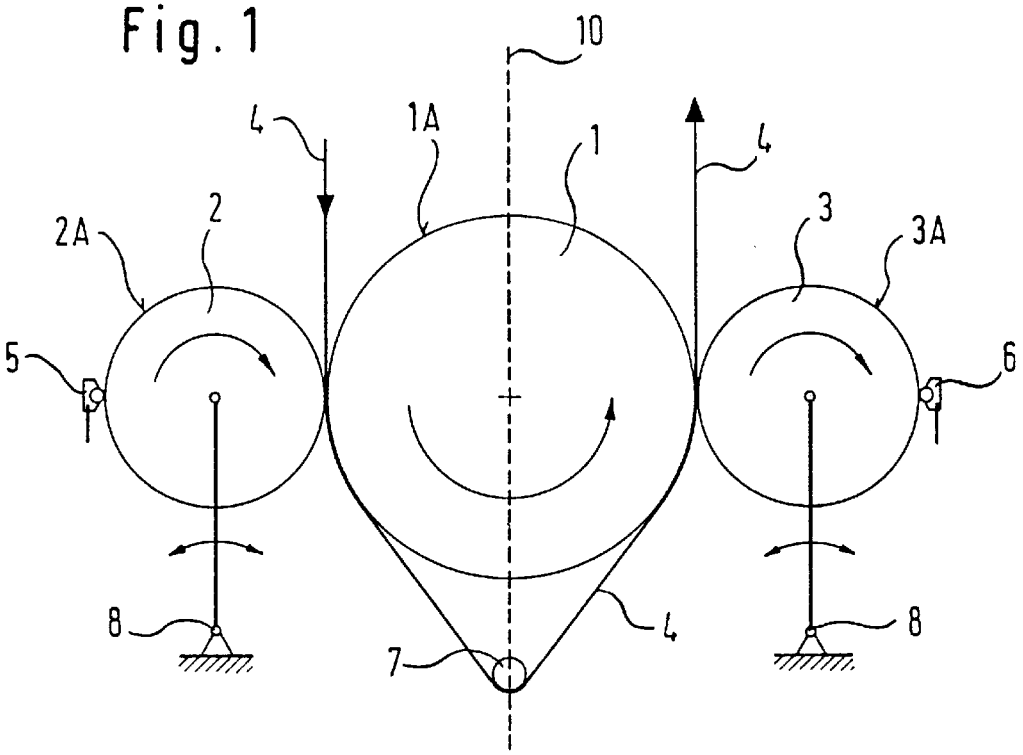
FIG. 1 is a schematic side view of a first embodiment of the apparatus presented by this invention.

The first embodiment shown in FIG. 1 includes a counter roller 1 that rotates around its center axis in the direction indicated by the arrow, that is in counter clock wise rotation. A first applicator roller 2 is positioned to the left of counter roller 1 so that the outer surface 2A of the first applicator roller 2 is in intimate contact with outer surface 1A of counter roller 1, forming a first press nip at their point of contact. A second applicator roller 3 is located to the right of counter roller 1, thus forming a symmetrical arrangement around a plane 10 which passes vertically through the center axis of counter roller 1. The second applicator roller 3 is positioned such that the outer surface 3A of first applicator roller 3 is in intimate contact with outer surface 1A of counter roller 1, forming the second press nip in this apparatus at their point of contact. The applicator rollers rotate in the directions indicated by the arrows, both in clock wise rotation, around their respective axes of symmetry, thus both are rotating opposite or "against" the relative rotation of counter roller 1. Both applicator rollers are mounted on supports which can be tilted about the axes 8, so that they can be brought closer to or away from the outer surface of the counter roller. A moving layer of material 4, for example paper, cardboard, or some textile, first enters into the first press nip, moves along a segment where it touches the outer surface 1A of the counter roller 1, is lifted away from the surface 1A of the counter roller 1 by an expander roller 7, then touches back onto the outer surface 1A of the counter roller until it has passed through the second press nip, then is moved away in a direction that is parallel but opposite to the path that brought the material layer 4 to the first press nip. The trajectory of the material layer 4 passing through the apparatus is indicated by two arrows in FIG. 1. It is evident from FIG. 1 that the trajectory of this path along which the material layer 4 moves is symmetrical with respect to the plane of symmetry 10.

The example which is illustrated incorporates an expander roller 7 to stretch the path of the material layer in order to prevent folds or wrinkles to form in the layer of material 4. But it is entirely possible to let the layer of material be supported by the outer surface 1A of the counter roller 1 along the entire path from the first press nip to the second press nip.

The schematic furthermore indicates an applicator implement which is made up of a combination of a spreading device and pressure chamber and which is assigned to the outer surface 2A of the first applicator roller 2. The schematic also shows a second applicator implement 6 which is made up of a combination of a spreading device and pressure chamber and which is assigned to the outer surface 3A of the second applicator roller 3.

The following explanations illustrate the how the apparatus shown in FIG. 1 is intended to function. The applicator implement 5 applies a first liquid or pasty medium onto the outer surface 2A of the first applicator roller 2. This pasty or liquid medium is then transferred onto the moving layer of material 4 as this passes through the first press nip, where the liquid or pasty medium is pressed into the layer of material. The second applicator implement 6 applies a second liquid or pasty medium onto the outer surface 3A of the second applicator roller 3. As the moving layer of material 4 approaches the second press nip and while the first layer of coating is still moist the second medium is transferred from the second applicator roller 3 onto the material layer 4 as a finish coating, which is then pressed into material layer 4 just as the first coating. This process is targeted to apply two layers of coating onto the same side of a moving layer of material without an intermediate drying of the first layer between the two applicator rollers.

The next two examples of the embodiments of this apparatus, illustrated in FIGS. 2 and 3, incorporate similar or identical components which are represented with the same reference numbers as in FIG. 1 and are explained in the following paragraphs.

Figure 2:
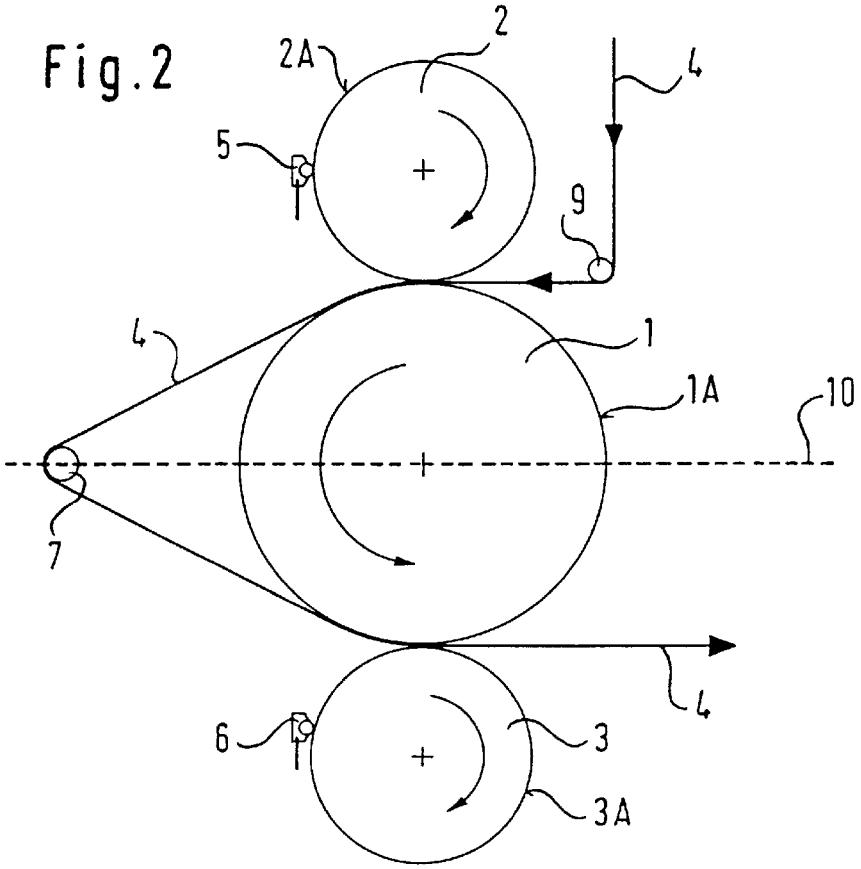
FIG. 2 is a schematic side view of a second embodiment of the apparatus presented by this invention.

The lay out of the second example, shown in FIG. 2, corresponds to that shown in the example shown in FIG. 1 with the important difference that the plane of symmetry is horizontal in FIG. 2 while it is vertical in FIG. 1. The layer of material 4 moves initially vertically downward, then turns 900 around a deflection pulley 9 which is positioned in front of the first applicator roller 2, before it enters the first press nip. Similar deflection pulleys can be utilized next to the second applicator roller to control the trajectory of the moving material layer after it leaves the second press nip. The use of deflector pulleys is a useful tool to effectively control the material layer movement in confined spaces.

Figure 3:
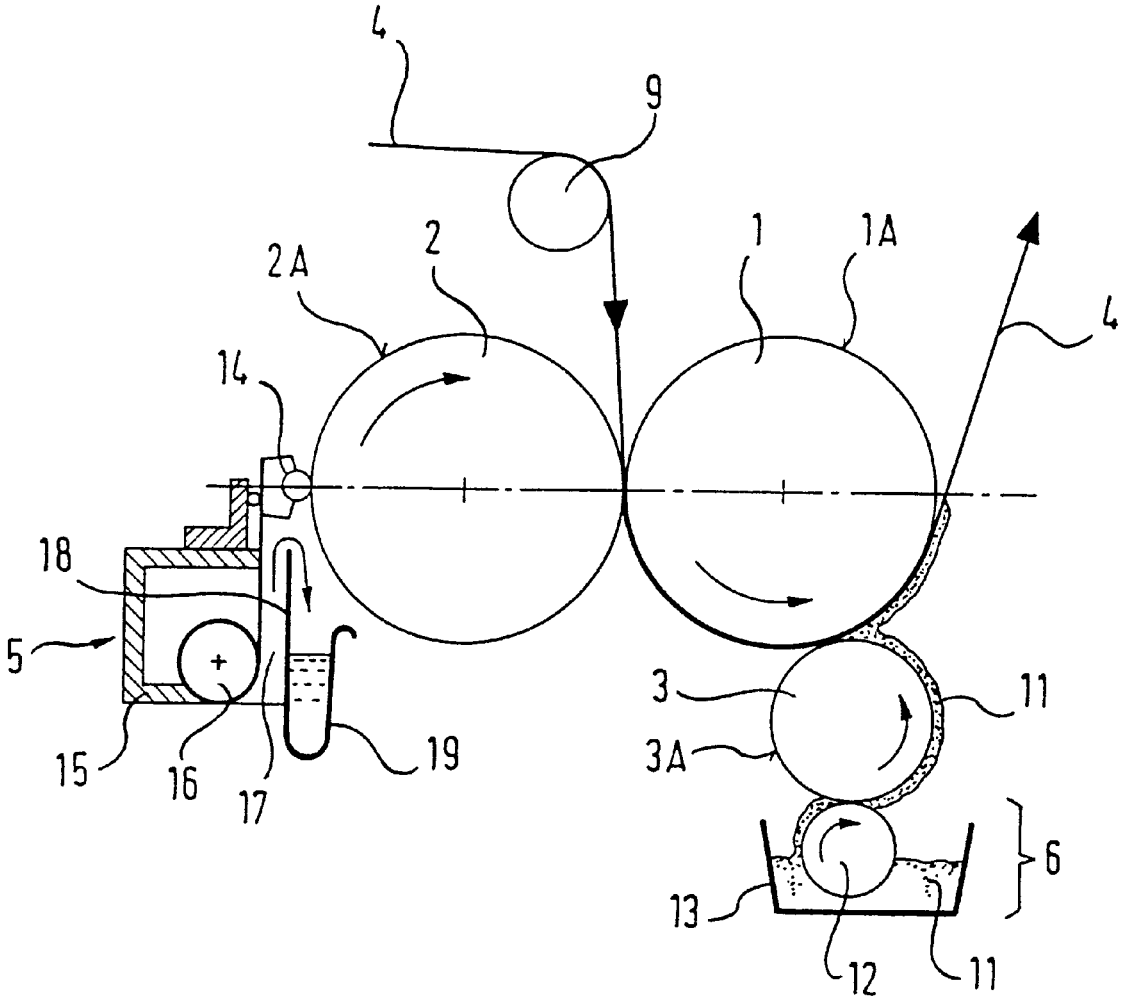
FIG. 3 is a schematic side view of a third embodiment of the apparatus presented by this invention.

The example illustrated in FIG. 3 differs from the previous two examples in the way in the way the second layer of coating medium is applied. As indicated by an arrow the second applicator roller 3 in the same way as the counter roller 1, both rotating clockwise around their central axes. The apparatus features the second applicator 3 roller equipped with a scooping arrangement 6 in place of the applicator implement. This scooping arrangement 6 consists of a scoop roller 12 which scoops the second liquid or pasty medium 11 out of a container 13 and then transfers it onto the outer surface 3A of the second applicator roller 3. From there the liquid or pasty medium 11 is moved to the open gap that exists between the second applicator roller 3 and the counter roller 1. The moving material layer 4 is supported by the outer surface 1A of the counter roller 1 as it is guided through this open gap so that the incoming liquid or pasty substance 11 is collecting at the side of the gap where the outer surface 3A of the second applicator roller 3 is approaching the gap. The importance of this process is that the liquid or pasty medium is applied very gently onto the first layer of coating on top of the moving material layer 4.

The components of the first applicator implement 5 are all mounted on a support structure 15. The liquid or pasty medium 11 passes through a distributor pipe 16, then through a supply channel 17, before it enters the applicator chamber, which itself is formed by the spreader element 14, deckle boards 18 as well as the outer surface 2A of the first applicator roller 2. The liquid or pasty medium leaves the pressurized chamber and is distributed by a spreader element, for example a rolling wiper stick, onto the outer surface 2A of the first applicator roller. Excess medium can flow over the deckle board 18 and be caught in the collector bin 19. The procedure illustrated in FIG. 3 is particularly suited for applying coatings with very low viscosities, such as for example thermo-sensitive finish coatings for FAX paper or micro capsule finish coating. This "reverse-roll" process, which employs counter movement of the counter roller 1 to relative to the second applicator roller 3, is especially useful for media that are very sensitive to shearing.

The processes and devices presented in this invention are very useful for applying very thin pre coatings, such as pre coating thicknesses of approximately 5–10 $g/m^2$. The thicknesses of the corresponding finish coatings on the other hand can be in excess of 20 $g/m^2$.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An apparatus for applying two coats of at least one coating medium to a traveling fiber material web, said apparatus comprising:

a rotating counter roller for carrying the traveling fiber material web;

a first applicator roller having a first outer surface and rotating in a direction opposite to said counter roller, said first applicator roller positioned adjacent to said counter roller and defining a first press nip with said counter roller through which the fiber material web can travel;

a first applicator implement for applying a first coat of coating medium onto said first outer surface;

a second rotating applicator roller having a second outer surface, said second applicator roller positioned adjacent to said counter roller at a location where the fiber material web is carried by said counter roller and after said first press nip relative to a direction of travel of the fiber material web;

a second applicator implement for applying a second coat of coating medium onto said second outer surface; and an expander roller for carrying the traveling fiber material webs said expander roller being disposed after said first applicator roller and before said second applicator roller relative to the direction of travel of the fiber material web, said expander roller being configured to stretch the fiber material web to thereby prevent at least one of folds and wrinkles in the fiber material web.

2. The apparatus of claim 1, further comprising:

a first support having a first axis, said first applicator roller being mounted on said first support such that said first applicator roller can be pivoted about said first axis at least one of toward and away from said counter roller; and a second support having a second axis, said second applicator roller being mounted on said second support such that said second applicator roller can be pivoted about said second axis at least one of toward and away from said counter roller.

3. The apparatus of claim 1, wherein said counter roller has a third outer surface, said second applicator roller being disposed approximately 180° past said first applicator roller along said third outer surface of said counter roller relative to the direction of travel of the fiber material web.

4. The apparatus of claim 1, wherein said second applicator roller defines a second press nip with said counter roller through which the fiber material web can travel.

5. The apparatus of claim 1, wherein said second applicator roller comprises a scoop roller and further comprising a holding container, said scoop roller scooping said coating medium from said holding container.

6. The apparatus of claim 1, wherein said first applicator implement comprises a jet chamber applicator.

7. The apparatus of claim 6, wherein said jet chamber applicator comprises a pressurized chamber applicator having a spreader element and a deckle board, said pressurized chamber applicator including a closed applicator chamber defined by said spreader element, said deckle board and said second outer surface.

8. The apparatus of claim 6, wherein said jet chamber applicator comprises a free jet nozzle.

* * * * *

UNITED STATES PATENT AND TRADEMARK OFFICE

CERTIFICATE OF CORRECTION

PATENT NO. : 6,063,192

DATED : May 16, 2000

INVENTOR(S) : Gottwald, et al.

It is certified that error appears in the above-identified patent and that said Letters Patent is hereby corrected as shown below:

Column 6

Line 18, after "implement", insert --5--; and

Line 54, delete "900", and substitute --90°-- therefor.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*